US007704190B2

(12) United States Patent
Lin et al.

(10) Patent No.: US 7,704,190 B2
(45) Date of Patent: Apr. 27, 2010

(54) POWER GENERATION DEVICE FOR EXERCISE EQUIPMENT

(75) Inventors: Jung-Chou Lin, Taichung (TW); Chun Lin, Taiping (TW)

(73) Assignee: KING I TECH Corporation, Taichung (TW)

( * ) Notice: Subject to any disclaimer, the term of this patent is extended or adjusted under 35 U.S.C. 154(b) by 0 days.

(21) Appl. No.: 12/410,852

(22) Filed: Mar. 25, 2009

(65) Prior Publication Data

US 2010/0062903 A1 Mar. 11, 2010

(30) Foreign Application Priority Data

Sep. 10, 2008 (TW) ..... 97216316 U

(51) Int. Cl.
*A63B 71/00* (2006.01)

(52) U.S. Cl. ..... 482/2; 482/1; 482/903

(58) Field of Classification Search ..... 482/1–9, 482/900–903; 434/247
See application file for complete search history.

(56) References Cited

U.S. PATENT DOCUMENTS 6,084,325 A * 7/2000 Hsu ..... 310/74
6,846,270 B1 * 1/2005 Etnyre ..... 482/6
7,018,324 B1 * 3/2006 Lin ..... 482/63

* cited by examiner

*Primary Examiner*—Glenn Richman
(74) *Attorney, Agent, or Firm*—Egbert Law Offices PLLC

(57) ABSTRACT

The present invention provides a power generation device for exercise equipment including a fixing seat, a swinging seat and a power generating component. The joint and positioning end of the swinging seat has a hinge connection part to be connected with the fixing seat, and the power generating component is configured on a preset position on the swinging seat. A magnetic lifting component is configured to cause magnetic repelling between the swinging end of the swinging seat and the fixing seat, so that the swinging end of the swinging seat can be elastically lifted. The driven part of the power generating component will constantly maintain tight contact with the flywheel of exercise equipment. The magnetic lifting component can exert a magnetic repulsing function without elastic fatigue and solid abrasion.

7 Claims, 8 Drawing Sheets

POWER GENERATION DEVICE FOR EXERCISE EQUIPMENT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a power generation device for exercise equipment, and more particularly to an innovative device with a magnetic support component to cause magnetic repellence between the swinging seat and the fixing seat for a supporting effect in a stepper exercise machine.

2. Description of Related Art Including Information Disclosed Under 37 CFR 1.97 and 37 CFR 1.98.

In prior art power generation devices for exercise equipment, a driven wheel is configured to contact a flywheel, which is driven by friction. However, in the prior art, after a certain exposure to friction between the driven wheel and the flywheel, the surface of the driven wheel will be inevitably worn out, and the outer diameter will be reduced. Consequently, the flywheel can no longer be driven by the driven wheel, and the power generating function will disappear.

In consideration of the above problem, the industry has developed an improvement that can maintain constant tight contact between the driven wheel and the flywheel of the exercise equipment through the pull or push of a spring component. However, in actual usage of such prior art structures, it is still found that the spring component, no matter its action is pull or push, will quickly lose its elasticity due to tiredness after repeatedly squeezing or traction, and consequently affecting the support effect of the driven wheel. Hence, there is a problem of insufficient durability and a short life span.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The power generation device for exercise equipment disclosed in the present invention uses an innovative and unique magnetic lifting component configured at corresponding positions on the swinging end of the swinging seat and the fixing seat. Magnetic force repels the swinging end of the swinging seat from the fixing seat, and the swinging end of the swinging seat is elastically lifted. As a result, the driven part of the power generating device will constantly maintain tight contact with the flywheel of the exercise equipment, such as a stepper machine. Based on the above, the magnetic lifting component can exert a magnetic repelling function without elastic fatigue and solid abrasion, and the lifting mechanism of the power generation device of the exercise equipment can have longer durability and much better quality, which constitute a practical advancement.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
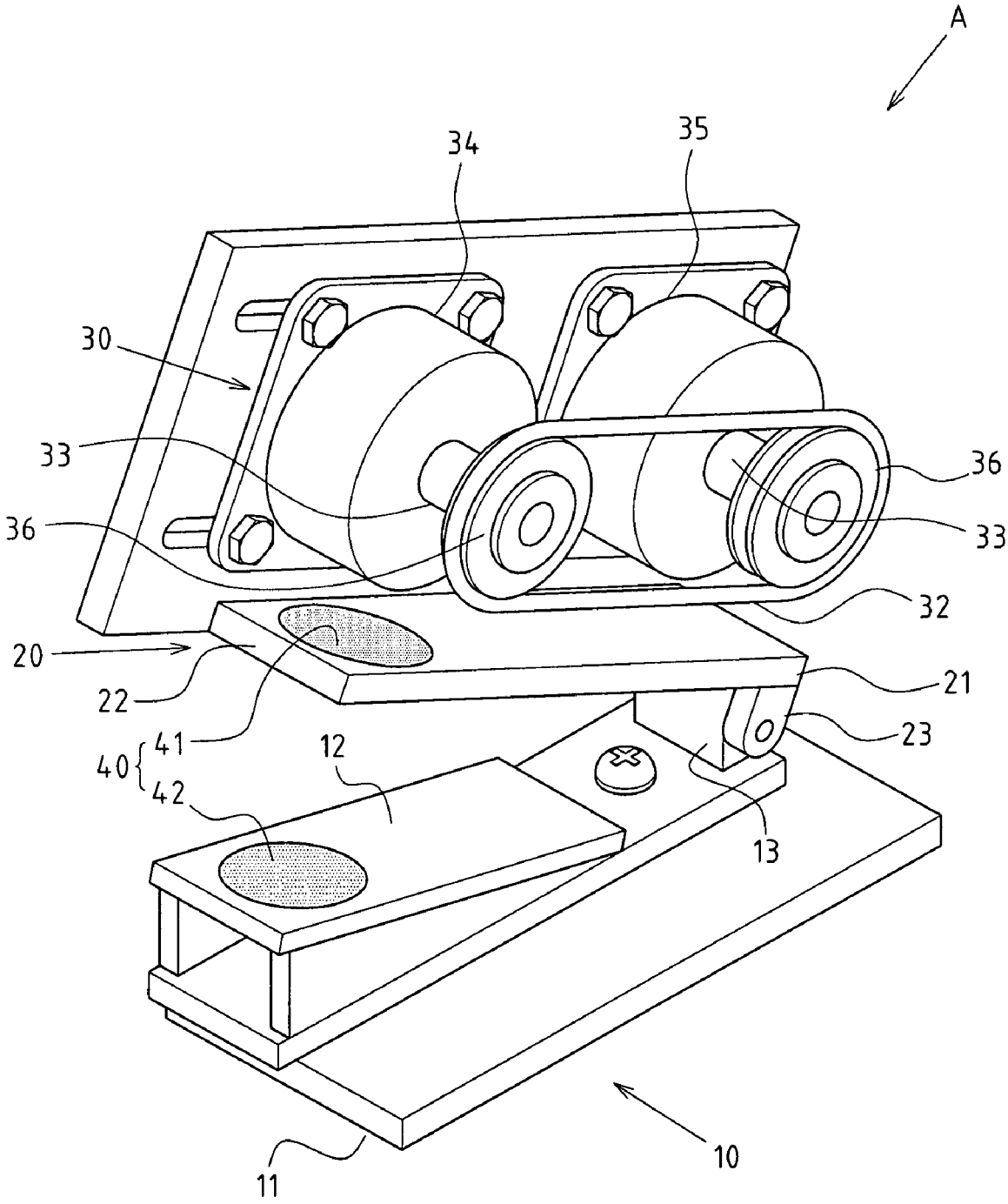
FIG. 1 shows a perspective view of a preferred embodiment of the power generation device for exercise equipment of the present invention.
Figure 2:
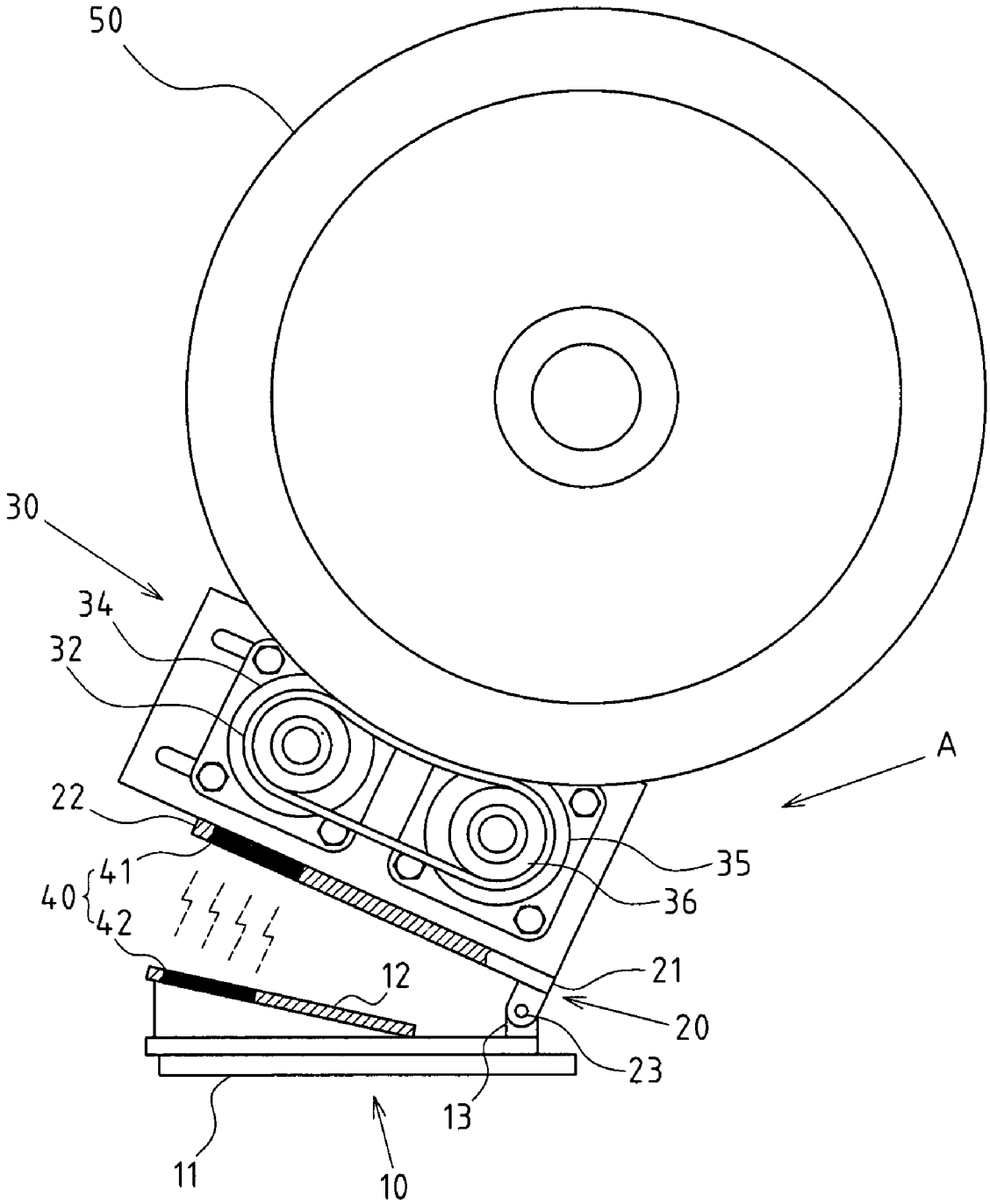
FIG. 2 shows a side elevation view of the driving status between the power generation device and flywheel for exercise equipment of the present invention.

FIGS. 1 and 2 depict a preferred embodiment of the power generation device for exercise equipment of the present invention. The embodiment is for descriptive purposes only and shall not restrict the range of patent application.

The power generation device A for exercise equipment comprises a fixing seat 10. The fixing seat comprises a landing and positioning part 11 and a component attachment surface 12. The component attachment surface 12 has a hinge part 13.

The present invention includes a swinging seat 20, comprising a joint and positioning end 21 and a swinging end 22. The joint and positioning end 21 has a hinge connection part 23 to be hinged with the hinge part 13 on the component attachment surface 12 of the fixing seat 10, so that the swinging end 22 of the swinging seat 20 can swing to various angles with the hinge connection part 23 as a pivot.

The present invention also includes a power generating component 30, attached to a preset position on the swinging seat 20. The power generating component 30 comprises a first and second power generating unit 34, 35 and a driven part 32. The first and second power generating unit 34, 35 both have an axis 33. The first and second power generating unit 34, 35 are spaced with an interval. The outside ends of the axis 33 of the first and second generating unit 34, 35 are both configured with a rotating wheel 36. The driven part 32 is a ring-shaped component (can be a rubber ring) winding on both the rotating wheels 36 configured on the axis 33 of the first and second power generating unit 34, 35, so that the axis 33 of the first and second power generating unit 34, 35 can rotate simultaneously under the drive by the driven part 32.

There is also a magnetic lifting component 40, configured at corresponding positions on the swinging end 22 of the swinging seat 20 and the component attachment surface 12 of the fixing seat 10. The magnetic lifting component 40 shall be configured to cause magnetic repelling between the swinging end 22 of the swinging seat 20 and the component attachment surface 12 of the fixing seat 10, so that the swinging end 22 of the swinging seat 20 can be elastically lifted. The detailed structural configurations of the magnetic lifting component 40 is described as below in combination with the attached drawings.

A magnetic lifting component 40 disclosed in FIG. 2, comprises a first magnet 41 configured on the swinging end 22 of the swinging seat 20 and a second magnet 42 configured on the component attachment surface 12 of the fixing seat 10. The corresponding sides of the first magnet 41 and the second magnet 42 are configured to have the same magnetic poles so as to cause magnetic repulsion.

Figure 3:
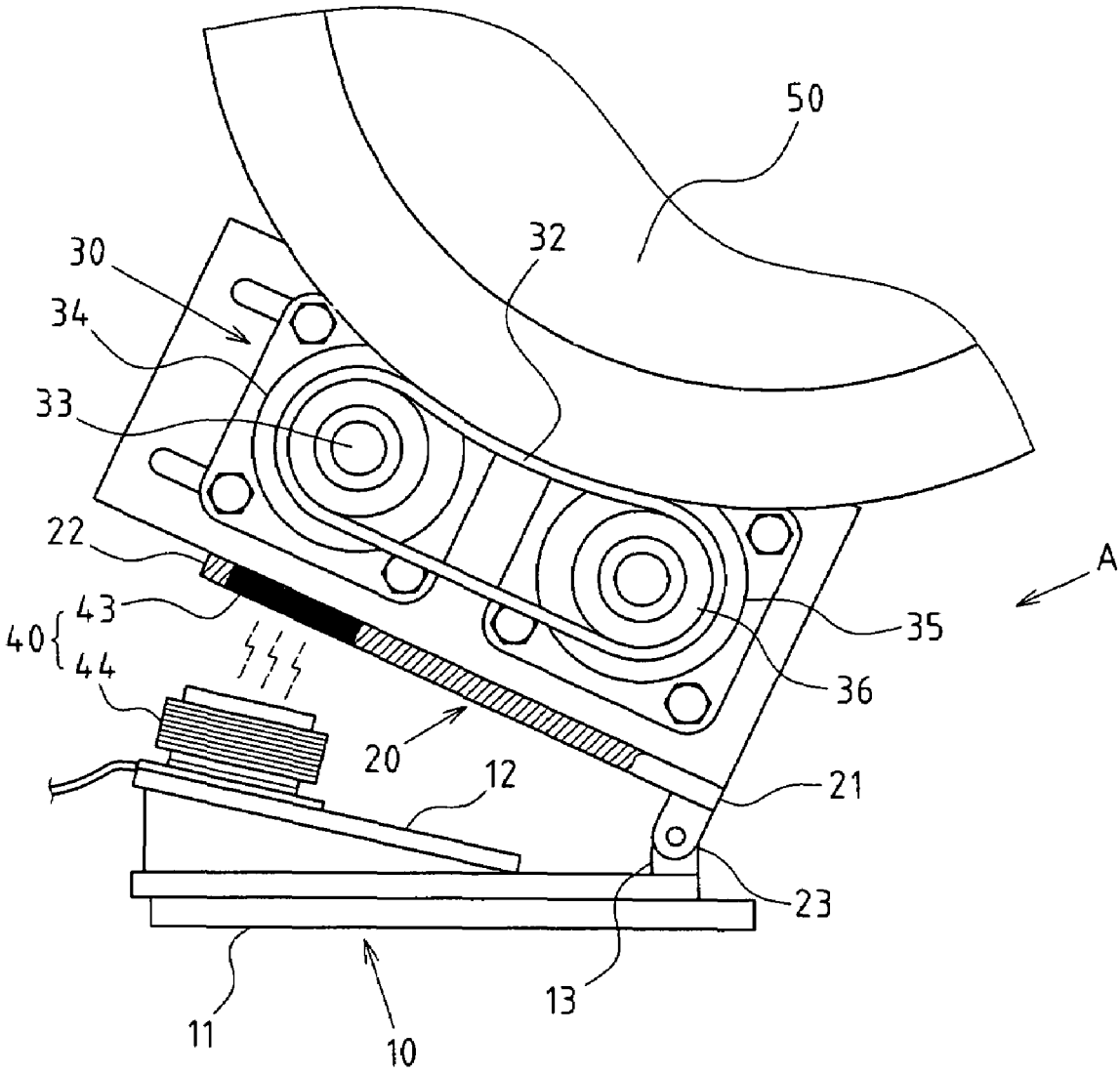
FIG. 3 shows a side elevation view of another embodiment of the magnetic lifting component of the present invention.

A magnetic lifting component 40 otherwise disclosed in FIG. 3, comprises a magnet 43 configured on the swinging end 22 of the swinging seat 20, and an electromagnet 44 configured on the component attachment surface 12 of the fixing seat 10. The magnetic poles of the electromagnet 44 and the magnet 43 on their corresponding sides are configured to be the same when there is electric connection, so as to cause magnetic repulsion.

The above structures constitute the present invention. Below is a description of the working conditions of a preferred embodiment of the present invention.

Referring to FIG. 2, in actual application of the power generation device for exercise equipment A, the driven part 32 winding between the rotating wheels 36 configured on the first power generating unit 34 and second power generating unit 35 tightly contacts one side of the flywheel 50 of an existing exercise apparatus. In this way, when the flywheel 50 rotates, it will drive the driven part 32 to run, and further drive the rotation of the first and second power generating unit 34, 35 to produce electricity. The core of the present invention is the magnetic lifting component 40 configured between the swinging end 22 of the swinging seat 20 and the component attachment surface 12 of the fixing seat 10 to cause a magnetic repulsing force, so as to elastically lift the swinging end 22 of the swinging seat 20. As a result, the driven part 32 will constantly maintain certain tightness and exert its driving function.

Figure 4:
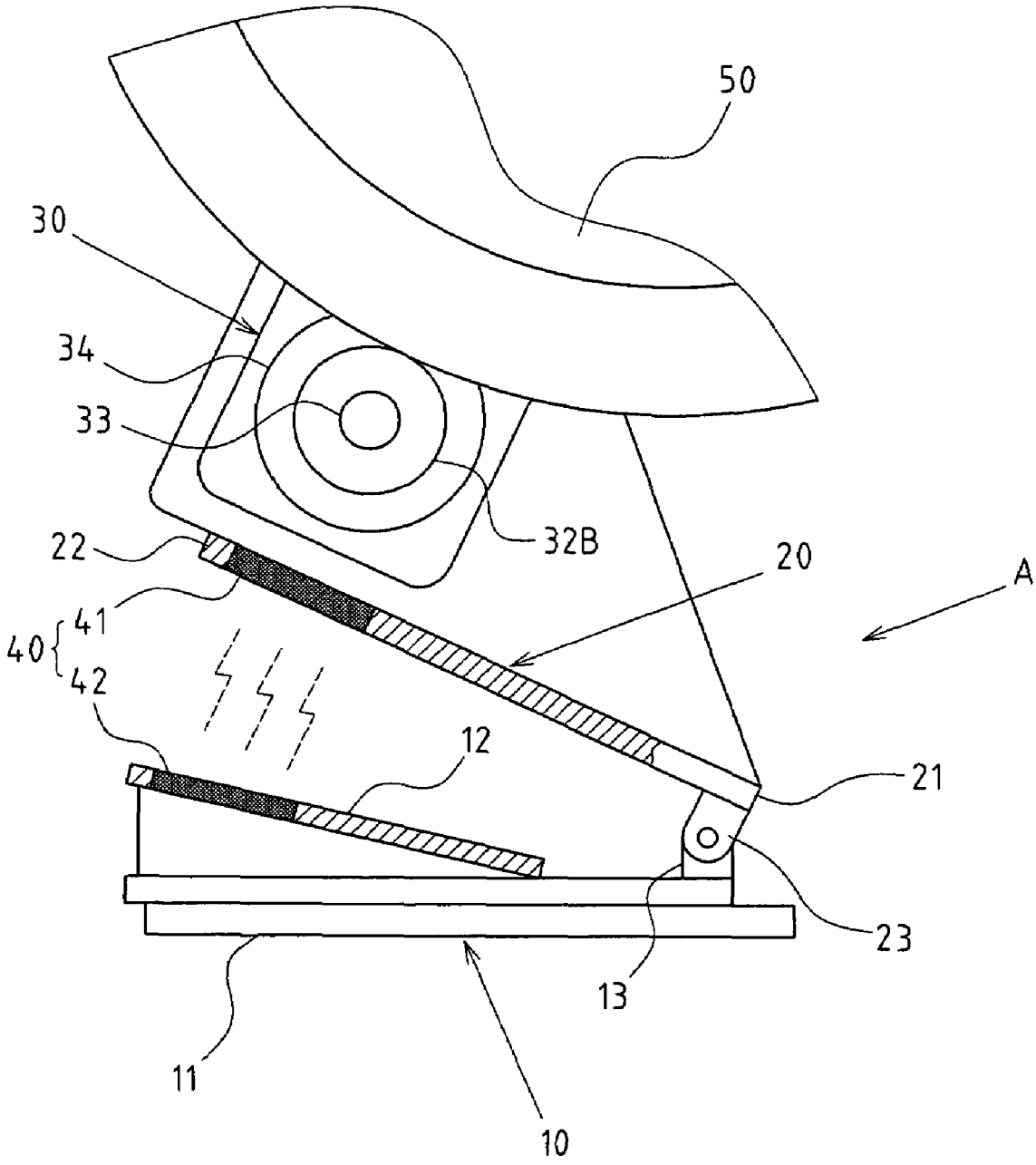
FIG. 4 shows a side elevation view of another embodiment of the power generating component of the present invention.

It is to be supplemented that, apart from the configurations of a first power generating unit 34 and second power generating unit 35 as disclosed above, the detailed constitution of the power generating component 30 can also be like the generating component 30 disclosed in FIG. 4, which comprises only one single power generating unit 34, and in which the driven part 32B is a rotating wheel configured on the axis 33 of the power generating unit.

Figure 5:
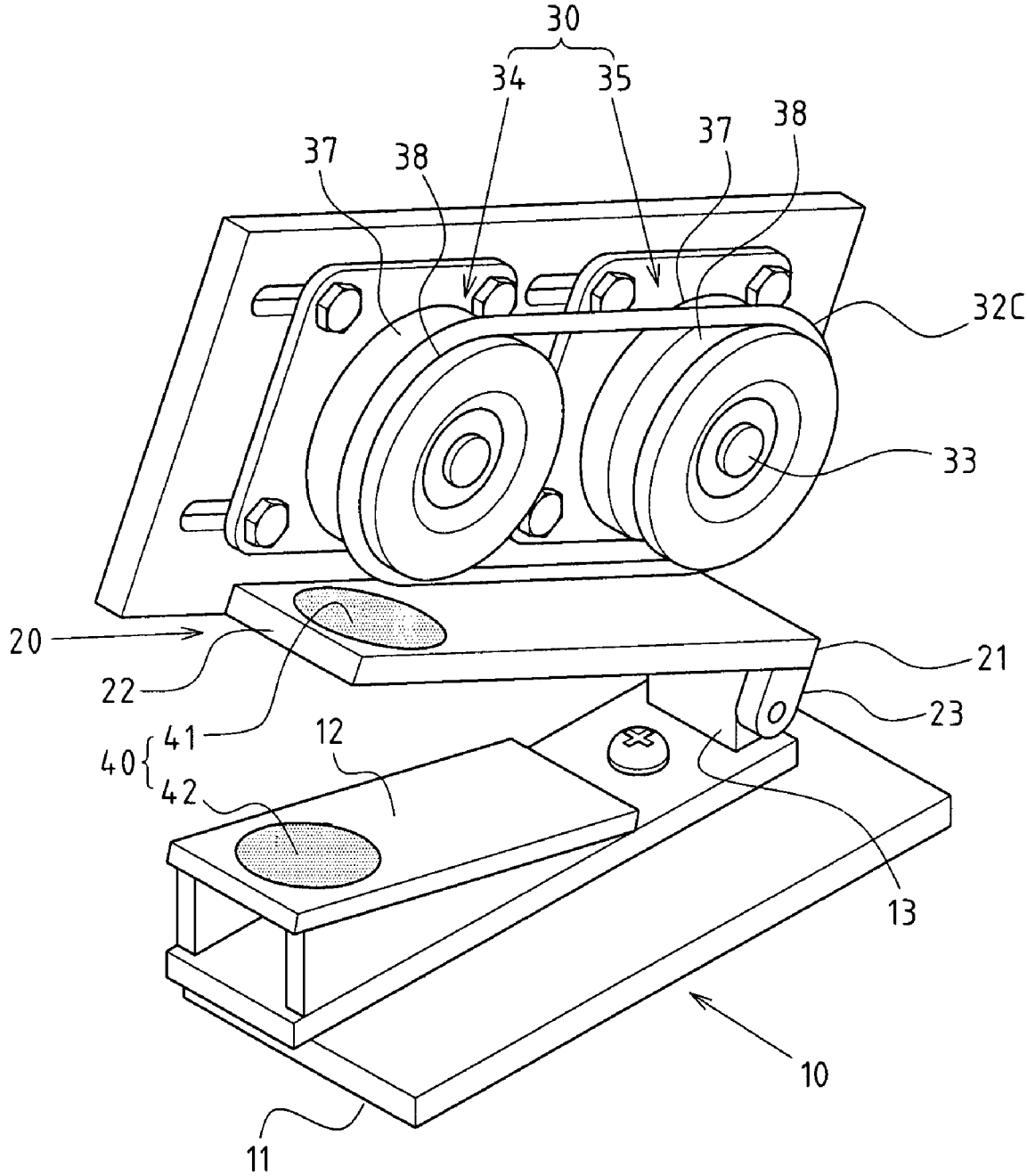
FIG. 5 shows a perspective view of another embodiment of the power generating device of the present invention.

Furthermore, the power generating component 30 shown in FIG. 5 also comprises a first power generating unit 34 and a second power generating unit 35 which are spaced with an interval. The first and second power generating unit 34, 35 comprise a rotating enclosure 37 to rotate simultaneously with the axis 33. On the periphery of the rotating enclosure 37, a ring groove 38 is configured. The driven part 32C is an elastic ring (such as rubber ring) winding on the ring groove 38 of the rotating enclosures 37 of the first and second power generating unit 34, 35. The driven part 32C is driven by the flywheel of the exercise equipment through frictional contact.

Figure 6:
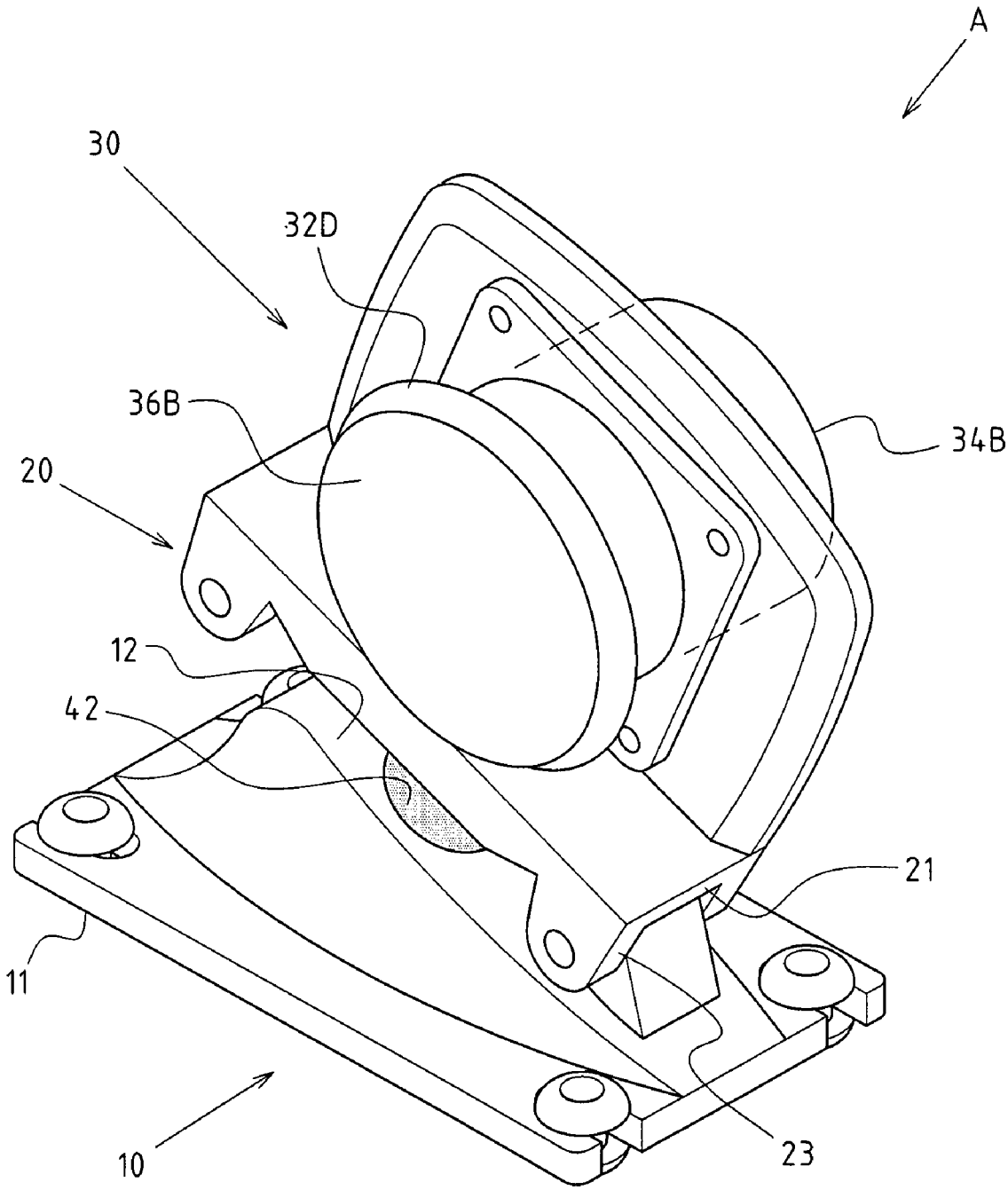
FIG. 6 shows a opposite side perspective view of another embodiment of the power generating device of the present invention.
Figure 7:
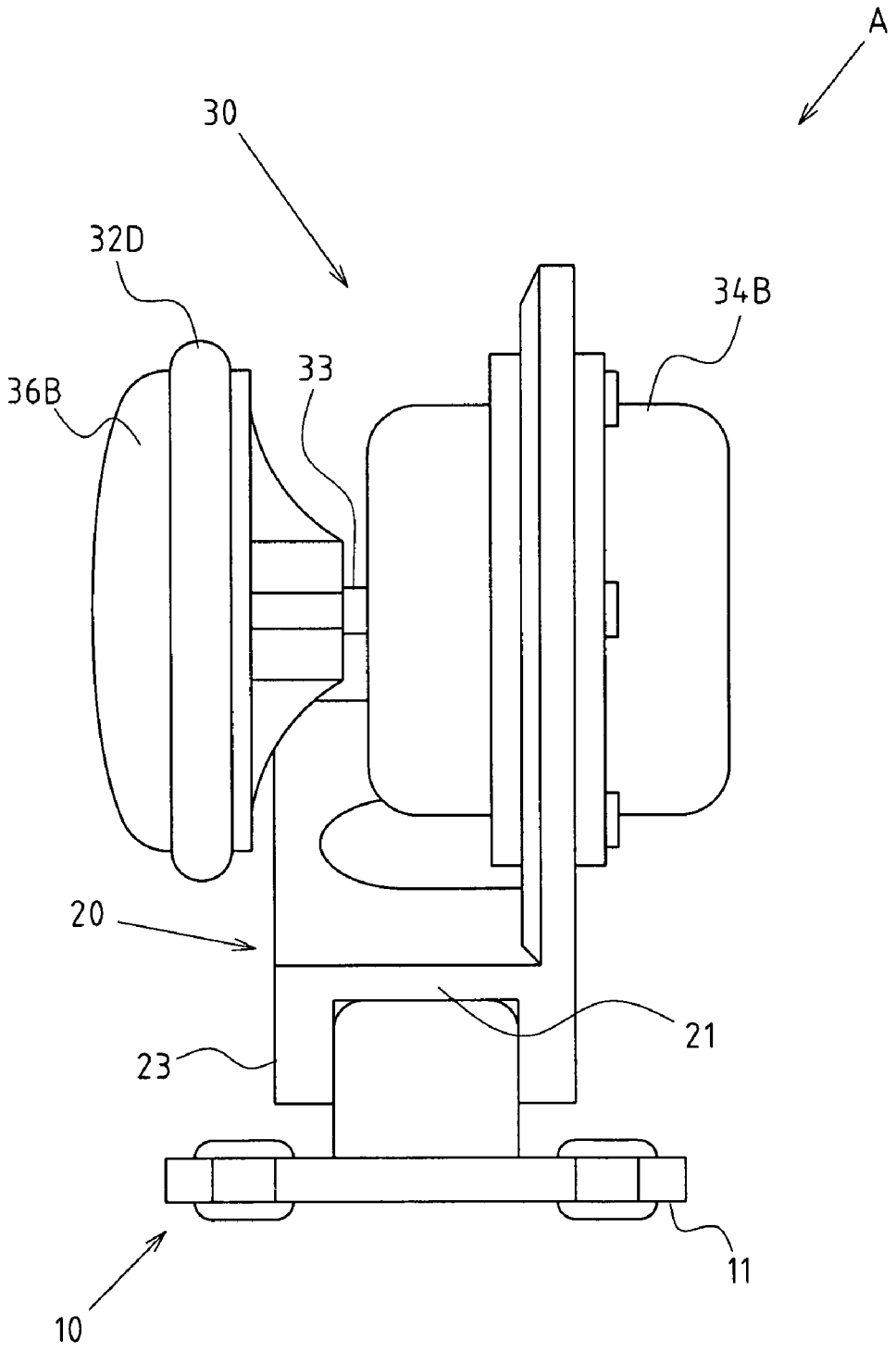
FIG. 7 shows a front elevation view of the embodiment disclosed in FIG. 6.

The power generating component 30 shown in FIGS. 6 and 7 is a variation of the configuration disclosed in FIG. 1. Difference of this embodiment is that the power generating component 30 only has one power generating unit 34B. The driven part 32D is also in the form of a ring component (can be a rubber ring) winding on the periphery of the rotating wheel 36B configured on the end of the axis 33 (disclosed in FIG. 7) of the power generating unit 34B. Apart from that, in this embodiment, the shapes of various outside parts of the fixing seat 10 and swinging seat 20 are also different from the shapes of the embodiment disclosed in FIG. 1-5.

Figure 8:
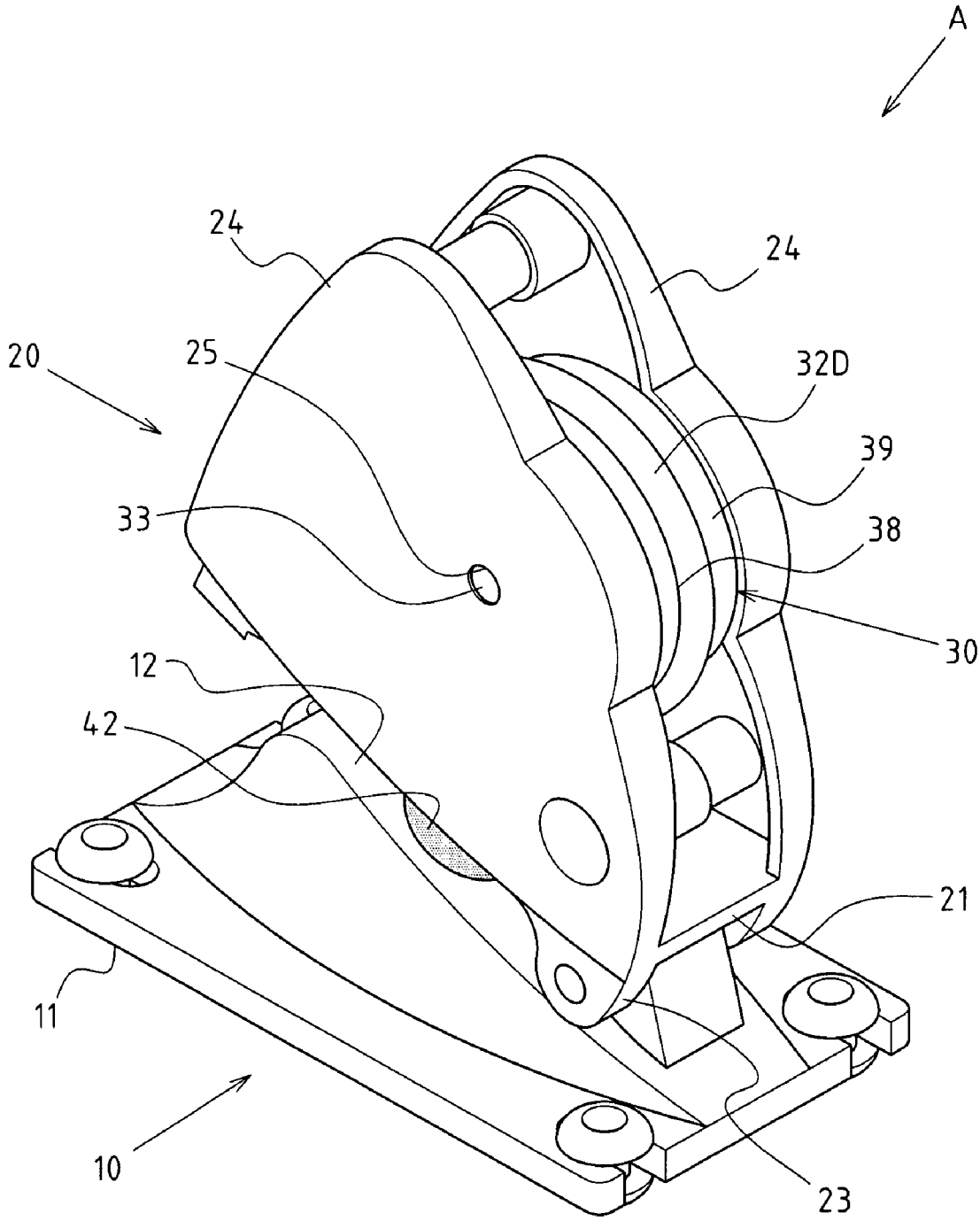
FIG. 8 shows another perspective view of still another embodiment of the power generating device of the present invention.

The power generating component 30 shown in FIG. 8 is one single power generating unit and has a rotating enclosure 39. The outside of the rotating enclosure 39 is wound by a driven part 32D in the form of an elastic ring. This embodiment is characterized by two frame boards 24 configured on the swinging seat 20 with an interval. The rotating enclosure 39 is held between the two frame boards 24, and the ends of the axis 33 are fitted in the axis holes 25 on the frame boards 24 so that the rotating enclosure 39 can rotate. The driven part 32D has one side protruding out of one side of the two frame boards 24.

We claim:

1. A power generation device for exercise equipment, the device comprising:

a fixing seat, comprising a landing and positioning part and a component attachment surface, said component attachment surface having a hinge part;

a swinging seat, comprising a joint and positioning end and a swinging end, said joint and positioning end having a hinge connection part connected to said hinge part on the component attachment surface of the fixing seat, said swinging end being pivoted at various angles with said hinge connection part as a pivot;

a power generating component, configured at a preset position on the swinging seat, said power generating component comprising a power generating unit and a driven part, said power generating unit having an axis; and a magnetic lifting component, configured at corresponding positions on said swinging end of the swinging seat and the component attachment surface of the fixing seat, said magnetic lifting component causing magnetic repulsion between the swinging end of the swinging seat and the component attachment surface of the fixing seat, the swinging end of the swinging seat being elastically maintained within a preset range of inclination angles.

2. The device defined in claim 1, wherein said power generating component comprises:

a first power generating unit; and a second power generating unit, the first and second power generating unit being spaced with an interval and having outside ends of a respective axis configured with a rotating wheel, said driven part being comprised of a ring component winding on the rotating wheels configured on the axis of the first and second power generating unit, the axis of the first and second power generating unit being simultaneously rotatable under drive by the ring component.

3. The device defined in claim 2, wherein each of said first and second power generating units further respectively comprise:

a rotating enclosure to act simultaneously with the axis; and a ring groove configured on a periphery of the rotating enclosure, the driven part being comprised of an elastic ring winding on the ring groove configured on the rotating enclosure of the first and second power generating unit.

4. The device defined in claim 1, wherein said power generating component comprises:

one single power generating unit, having an outside end of the axis of the power generating unit configured with a rotating wheel, said driven part being comprised of a ring component winding on the rotating wheel, the axis of the power generating unit being rotatable simultaneously under the drive by the ring component.

5. The device defined in claim 1, wherein said power generating component comprises:

one single power generating unit being comprised of a rotating enclosure acting simultaneously with the axis; and a ring groove configured on a periphery of the rotating enclosure, said driven part being comprised of an elastic ring winding on the ring groove of the rotating enclosure.

6. The device defined in claim 1, wherein said magnetic lifting component comprises:

a first magnet configured on the swinging end of the swinging seat; and a second magnet configured on the component attachment surface of the fixing seat, the magnet having magnetic poles on the corresponding sides of the first magnet and second magnet configured to be identical, causing magnetic repulsion.

7. The device defined in claim 1, wherein said magnetic lifting component comprises:

a magnet configured on the swinging end of the swinging seat; and an electromagnet configured on the component attachment surface of the fixing seat, the electromagnetic and the magnet have magnetic poles on the corresponding sides of the electromagnet and the magnet configured to be identical after connection to electric power, causing magnetic repulsion.

* * * * *